US007198706B2

(12) United States Patent
Lewis

(10) Patent No.: US 7,198,706 B2
(45) Date of Patent: Apr. 3, 2007

(54) METHOD FOR INHIBITING CORROSION OF METAL

(75) Inventor: Michael E. Lewis, Hartville, OH (US)

(73) Assignee: Canadian Auto Preservation Inc., Concord, Ontario (CA)

( * ) Notice: Subject to any disclaimer, the term of this patent is extended or adjusted under 35 U.S.C. 154(b) by 393 days.

(21) Appl. No.: 10/846,598

(22) Filed: May 17, 2004

(65) Prior Publication Data

US 2004/0211677 A1 Oct. 28, 2004

Related U.S. Application Data

(63) Continuation-in-part of application No. 10/010,402, filed on Dec. 7, 2001, now Pat. No. 6,875,336, which is a continuation-in-part of application No. 09/527,552, filed on Mar. 17, 2000, now Pat. No. 6,331,243.

(60) Provisional application No. 60/044,898, filed on Apr. 25, 1997.

(51) Int. Cl.
*C23F 13/00* (2006.01)

(52) U.S. Cl. ..... 205/725; 205/727; 205/740; 205/724; 204/196.02; 204/196.06; 204/196.11; 204/196.21; 204/196.26; 204/196.36; 204/196.37; 307/95

(58) Field of Classification Search ..... 205/724, 205/725, 727, 740; 204/196.01, 196.02, 204/196.06, 196.11, 196.21, 196.26, 196.36, 204/196.37; 307/95
See application file for complete search history.

(56) References Cited

U.S. PATENT DOCUMENTS

| | | | | |
|---|---|---|---|---|
| 3,242,064 | A | 3/1966 | Byrne | |
| 3,692,650 | A | 9/1972 | Kipps et al. | |
| 4,647,353 | A | 3/1987 | McCready | |
| 4,767,512 | A | 8/1988 | Cowatch et al. | |
| 4,828,665 | A | 5/1989 | McCready | |
| 4,950,372 | A | 8/1990 | McCready | |
| 5,102,514 | A | 4/1992 | McCready | |
| 6,046,515 | A | 4/2000 | Lewis | |
| 6,331,243 | B1 * | 12/2001 | Lewis | 205/727 |
| 6,875,336 | B2 * | 4/2005 | Lewis et al. | 205/724 |
| 2002/0088720 | A1 | 7/2002 | Lewis | |

* cited by examiner

*Primary Examiner*—Bruce F. Bell
(74) *Attorney, Agent, or Firm*—Dennis R. Haszko

(57) ABSTRACT

The present invention generally provides a method for prevention of corrosion in a metal object by inducing a surface current over the entire surface of the metal object. The surface current can be induced by direct or indirect application of electrical waveforms having AC components generated from a circuit. The metal body and the negative terminal of a source of DC voltage (battery) are grounded. The positive terminal of the source of DC voltage is connected to the electronic circuit that imparts electrical waveforms of low voltage DC to the conductive terminal connected to the metal body. Alternate methods of inducing surface currents include direct capacitor discharge through the metal body, or movement of an electromagnetic field over the metal body, or by generating an RF signal attached to a transmitting antenna such that the transmitted signal is received by the metal body.

25 Claims, 8 Drawing Sheets

METHOD FOR INHIBITING CORROSION OF METAL

CROSS REFERENCE TO RELATED APPLICATIONS

This application is a continuation-in-part of U.S. patent application Ser. No. 10/010,402 filed on Dec. 7, 2001, now U.S. Pat. No. 6,875,336, which is a continuation-in-part of U.S. patent application Ser. No. 09/527,552, filed Mar. 17, 2000, now U.S. Pat. No. 6,331,243, which is a continuation-in-part of U.S. patent application Ser. No. 09/066,174, now U.S. Pat. No. 6,046,515, which claims the benefit of U.S. Provisional Application No. 60/044,898, filed Apr. 25, 1997, the contents of all of which are incorporated herein by reference in their entirety.

FIELD OF THE INVENTION

The present invention relates generally to the process and apparatus for prevention of oxidation of metal objects in an oxidizing environment. More particularly, the present invention relates to apparatus and methods for generating surface currents on conducting bodies to inhibit corrosion.

BACKGROUND OF THE INVENTION

In an oxidizing environment, there are substances that under suitable conditions, take up electrons and become reduced. These electrons typically come from the atoms of metal objects exposed to the oxidizing environment An oxidizing environment is characterized by the presence of at least one chemical, the atoms of which, in that environment, are capable of being reduced by acquiring at least one electron from the atoms of the metal. In "donating" an electron, the metal becomes oxidized. As the process of oxidation continues, a metal object becomes degraded to the point that it can no longer be used for its intended purpose.

On land, oxidation is prevalent in, among other things, bridges and vehicles, when they are exposed to salt that is spread on roads to prevent the formation of ice in cold climates. The salt melts the snow and ice and, in so doing, forms an aqueous salt solution. The iron or steel in the bridges or vehicles, when exposed to the salt solution, is readily oxidized. The first visible sign of oxidation is the appearance of rust on the surface of the metal object. Continued oxidation leads to the weakening of the structural integrity of metal objects. If the oxidation is allowed to continue, the metal object rusts through and eventually disintegrates or, in the case of the metal in bridges, becomes too weak to sustain the load to which it is subjected. The situation has become worse in recent years with increased concentrations of pollutants and the demand for lighter, more fuel-efficient vehicles requiring thinner sheet metal and the abandonment of mainframe construction.

An aqueous salt solution is also the cause of corrosion in a marine environment and is responsible for the oxidation of hulls of ships, offshore pipelines, and drilling and production platforms used by the oil industry.

Early methods of corrosion prevention relied on applying a protective coating, for example of paint, to the metal object. This prevents the metal from coming in contact with the oxidizing environment and thereby prevents corrosion. Over a long time, however, the protective coating wears off and the process of oxidation of the metal can begin. The only way to prevent oxidation from starting is to reapply the coating. This can be an expensive process in the best of circumstances: it is much easier to thoroughly coat the parts of an automobile in a factory, before assembly, than to reapply the coating on an assembled automobile. In other circumstances, e.g., on an offshore pipeline, the process of reapplying a coating is impossible.

Other methods of prevention of oxidation include cathodic protection systems. In these, the metal object to be protected is made the cathode of an electrical circuit. The metal object to be protected and an anode are connected to a source of electrical energy, the electrical circuit being completed from the anode to the cathode through the aqueous solution. The flow of electrons provides the necessary source of electrons to the substances in the aqueous solution that normally cause oxidation, thereby reducing the "donation" of electrons coming from the atoms of the protected metal (cathode).

The invention of Byrne (U.S. Pat. No. 3,242,064) teaches a cathodic protection system in which pulses of direct current (DC) are supplied to the metal surface to be protected, such as the hull of a ship. The duty cycle of the pulses is changed in response to varying conditions of the water surrounding the hull of the ship. The invention of Kipps (U.S. Pat. No. 3,692,650) discloses a cathodic protection system applicable to well casings and pipelines buried in conductive soils, the inner surfaces of tanks that contain corrosive substances and submerged portions of structures. The system uses a short pulsed DC voltage and a continuous direct current.

The cathodic protection systems of the prior art are not completely effective even for objects or structures immersed in a conductive medium such as sea water. The reason for this is that due to local variations in the shape of the structure being protected and to concentrations of the oxidizing substances in the aqueous environment, local "hot spots" of corrosion develop are not adequately protected and, eventually, cause a breakdown of the structure. Cathodic protection systems are of little use in protecting metal objects that are not at least partially submerged in a conductive medium, such as sea water or conductive soil. As a result, metal girders of bridges and the body of automobiles can not be effectively protected by these cathodic systems.

Cowatch (U.S. Pat. No. 4,767,512) teaches a method aimed at preventing corrosion of objects that are not submerged in a conductive medium. An electric current is impressed into the metal object by treating the metal object as the negative plate of a capacitor. This is achieved by a capacitive coupling between the metal object and a means for providing pulses of direct current. The metal object to be protected and the means for providing pulses of direct current have a common ground. In his preferred embodiment, Cowatch discloses a device in which a DC voltage of 5,000 to 6,000 volts is applied to the positive plate of a capacitor separated from the metal object by a dielectric. Small, high frequency (1 kilohertz) pulses of DC voltage are superimposed on the steady DC voltage. Cowatch also refers to a puncture voltage of the dielectric material as about 10 kV.

Because of the safety hazards of having the high voltage applied at a place that exposes humans and animals to possible contact with the metal object or any other part of the capacitive coupling, Cowatch requires limitations on the maximum energy output of the invention.

Cowatch discloses a two-stage device for obtaining the pulsed DC voltage. The first stage provides outputs of a higher voltage AC and a lower voltage AC. In the second stage, the two AC voltages are rectified to give a high voltage DC with a superimposed DC pulse. Cowatch uses at least two transformers, one of which may be a push/pull saturated core transformer. Because of the use of transformers, the energy losses associated with the invention are high. Based on the disclosed values in Cowatch, the efficiency can be very low (less than 10%). The high heat dissipation may also require a method of dissipating the heat. In addition, the invention requires a separate means for shutting off the device during prolonged periods of non-use to avoid discharging the battery.

A somewhat related problem that affects submerged structures is caused by the growth of organisms. Mussels, for example, are a serious problem with municipal water supply systems and power plants. Because of their prolific growth, they clog the water intakes required for the proper operation of the water supply system or the power plant, causing a reduction in the flow of water. Expensive cleaning operations have to be carried out periodically. Barnacles and other organisms are well known for fouling the hulls of ships and other submerged parts of structures. Conventional means of dealing with this include the use of antifouling paints and thorough cleaning at regular intervals. The paints may have undesirable environmental effects while the cleaning is an expensive process, requiring that the ship be taken out of commission while the cleaning is done. Neither of these is effective in the long run.

It is a goal of the present invention to provide corrosion protection to metal objects even when the objects to be protected are not immersed in an electrolyte. It is a further goal of the present invention to accomplish this without exposing humans or animals to the risk of high voltages. In addition, the device should also be energy efficient, thereby reducing the drain on the power source and should not require any special means for heat dissipation. It also should, as part of the circuitry, have a battery voltage monitor that shuts off the pulse amplifier if the battery voltage drops below a predetermined threshold, thus conserving battery power. This is particularly useful because cold weather conditions under which corrosion is more likely due to exposure to salt used to melt ice on roadways, also imposes greater demands on a battery for starting a vehicle. In addition to cold weather, high temperatures and humidity also lead to increased corrosion simultaneously with increased demands on battery power for starting a vehicle. It is also a goal of the present invention to inhibit the growth of organisms on submerged structures. Finally, it is also a goal of the present invention to protect the circuitry from damage if the apparatus is inadvertently connected to the battery with reversed polarity.

It is, therefore, desirable to provide an improved control for corrosion protection.

SUMMARY OF THE INVENTION

It is an object of the present invention to obviate or mitigate at least one disadvantage of previous corrosion inhibition methods. In particular, it is an object of the invention to provide a circuit and method for reducing the rate of corrosion of a metal object.

In a first aspect, the present invention provides a method for reducing a rate of oxidation of a metal object. The method includes the steps of generating electrical waveforms, coupling the electrical waveforms to the metal object, and inducing a surface current over an entire surface of the metal object in response to the electrical waveforms. The electrical waveforms have predetermined characteristics and are generated from a DC voltage source, such that each waveform has a temporal AC component.

In an embodiment, of the present aspect, the step of coupling includes driving the electrical waveforms through at least two contact points on the metal object, the step of generating can include generating electrical waveforms having a shape conducive for generating the AC component, and the electrical waveforms can include a resonance frequency of the metal object. In another embodiment of the present aspect, the step of coupling can include capacitively coupling the electrical waveforms from a first terminal to a second terminal connected to the metal object, where the second terminal is connected to a ground terminal of the DC voltage source.

In yet another embodiment of the present aspect, the step of capacitively coupling can include charging a capacitor from the DC voltage source and discharging stored charge of the capacitor through the metal object to a ground connection between the DC voltage source and the metal object in response to the electrical waveforms. In alternate aspects of the present embodiment, the capacitor can be mechanically charged, a first terminal of the capacitor can be connected to the metal object and a second terminal of the capacitor can be connected to an area of the metal object distant from the ground connection, and a polarity of the DC voltage source can be reversed after the stored charge is discharged.

In an alternate embodiment of the present aspect, the step of capacitively coupling can include charging a capacitor from the DC voltage source and discharging stored charge of the capacitor to a distributed capacitor coupled to the metal object in response to the electrical waveforms, where the induced surface current travels in a first direction in response to accumulation of stored charge on the distributed capacitor. In an aspect of the present embodiment, the step of coupling can include moving a magnetic field over the metal object at a frequency corresponding to the predetermined frequency of the signal pulses.

According to further alternate embodiments of the present aspect, the step of coupling can include transmitting RF signals corresponding to the electrical waveforms through an antenna for receipt by the metal object, the step of generating can include generating the electrical waveforms with rise and fall times of about 200 nanoseconds, and the step of generating can include generating unipolar DC electrical waveforms or bipolar DC electrical waveforms.

In a second aspect, the present invention provides a circuit for reducing the rate of corrosion of a metal object. The circuit includes a charge circuit having a DC voltage source, and a current generation circuit coupled to the metal object. The charge circuit has a DC voltage source for providing a capacitive discharge, where a terminal of the DC voltage source being connected to the metal object. The current generation circuit is coupled to the metal object for receiving and shaping the capacitive discharge from the charge circuit, the current generation circuit couples the shaped capacitive discharge to the metal object for inducing a surface current therein.

In an embodiment of the present aspect, the charge circuit can include a capacitor arranged in parallel to the DC voltage source, and a switch circuit for coupling the capacitor to the DC voltage source in a charging position for charging the capacitor, the switch circuit coupling the capacitor to an output in a discharging position for discharging the capacitor. The current generation circuit can include an impedance device coupled between the output and the metal object for providing a shaped current waveform, the surface current being induced as the shaped current waveform is applied to the metal object. The DC voltage source can include a polarity switch circuit for reversing the polarity of the DC voltage source.

In an aspect of the present embodiment, the current generation circuit can include a distributed capacitor coupled to the metal object, an impedance device coupled between the output and the distributed capacitor for providing a shaped current waveform, the distributed capacitor receiving the charge from the shaped current waveform to induce the surface current, and a discharge circuit for discharging the charge of the distributed capacitor to the terminal for inducing a second surface current opposite in direction to the surface current. The discharge circuit can include a second impedance device coupled between the distributed capacitor and a discharge switch circuit, the discharge switch circuit selectively coupling the second impedance device to the terminal. The distributed capacitor can include at least two parallel connected individual plates, where each of the at least two parallel connected individual plates has a different surface area.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

The present invention generally provides a method for reducing the rate of corrosion in a metal object by inducing a surface current over the entire surface of the metal object. The surface current can be induced by direct or indirect application of electrical waveforms having AC components, in response to the electrical waveforms generated from a circuit. Electrical waveforms have a time varying component with characteristics such as frequency spectrum, repetition rate, rise/fall time, pulses, sinusoids, and combinations of pulses and sinusoids. The metal body and the negative terminal of a suitable electrical source, such as a DC voltage (battery), are grounded. The positive terminal of the source of DC voltage is connected to the electronic circuit that imparts low voltage electrical waveforms to the conductive terminal connected to the metal body. The time varying AC components in the electrical waveform responsible for inducing the surface currents are effective in inhibiting corrosion, and hence their generation is favoured. Alternate methods of inducing surface currents include direct capacitor discharge through the metal body, or movement of an electromagnetic field over the metal body, or by generating a signal, with an appropriate waveform from an RF source attached to a transmitting antenna such that the transmitted signal is received by the metal body.

According to embodiments of the present invention, the generation of electrical waveforms having a shape conducive for generating the time varying (AC) component is effective for reducing the rate of oxidation. The electrical waveforms may, but do not necessarily, include a frequency at which the metal object resonates. It has been established that electrical waveforms of a unipolar pulse with a nominal period of 100 uS, width of 3 uS and rise and fall times of approximately 200 nanoseconds, are effective at preventing corrosion even when a bulk electrolyte is not present. Given that: i) it has been determined that the surface currents induced on the metal body by the electrical waveform are responsible for the reduction of the rate of corrosion and i) in principle, any electrical waveform with an AC component can induce a surface current on a metal object, when properly coupled to a metal object. Therefore, it is clear that the possible number of suitable electrical waveforms suitable for the reduction of the rate of corrosion is virtually infinite. These surface currents can be attributed to the skin effect phenomenon, where high frequency electric current has a tendency to distribute itself with a higher current density near the surface of a conductor than at its core.

Figure 1A:
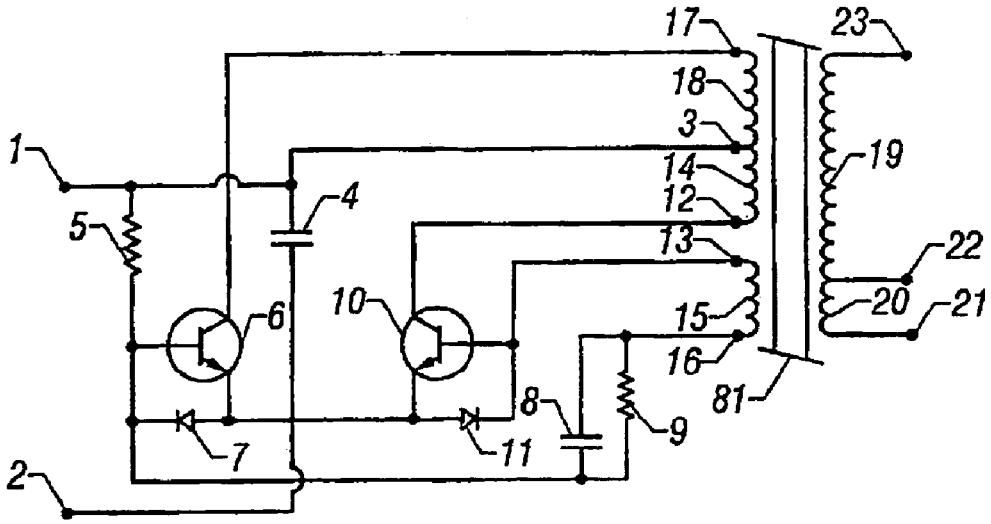
FIG. 1A (Prior Art)
FIGS. 1A and 1B are circuit diagrams of the prior art of Cowatch.
Figure 1B:
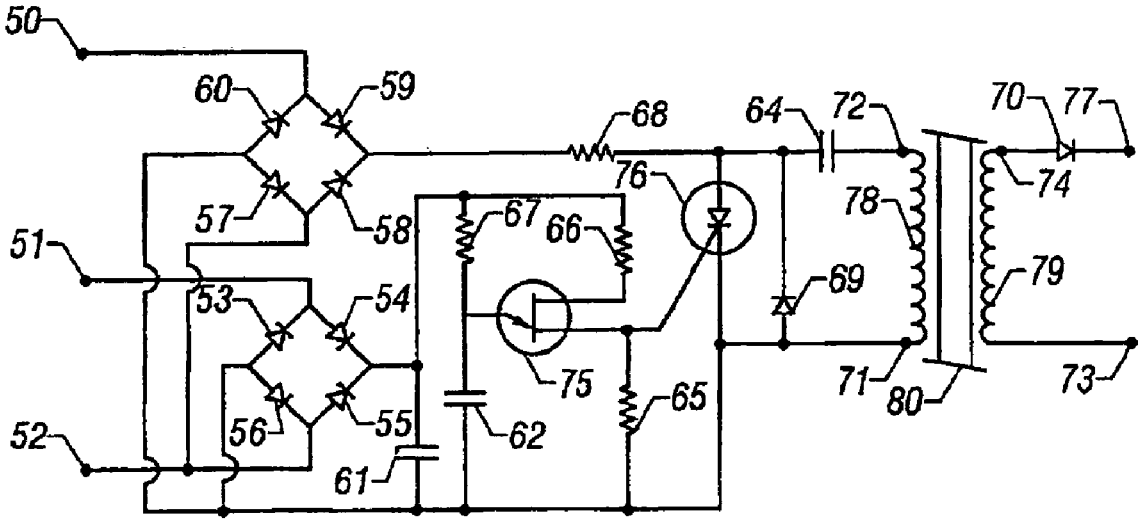
FIG. 1B (Prior Art)

The present invention is best understood by first referring to prior art methods of preventing oxidation of metal by capacitive coupling. FIG. 1A shows the circuit diagram of a push/pull saturated core transformer used in the invention of Cowatch. Generally, terminal 1 is connected to the positive side of the electrical system of a vehicle and terminal 2 is connected to the negative side of the electrical system of the vehicle. The output of the transformer 81 has three taps, 21, 22 and 23. The tap 21 provides the system ground, 22 provides 12 volts AC and 23 provides 400 volts AC. The output from the first stage is fed to the second stage, a rectifier pulsator, the circuit diagram of which is shown in FIG. 1B. The 400 volt AC from 23 is fed to 50, the 12 volt AC from 22 is connected to 51 while the ground 21 is connected to 52. The output of the rectifier pulsator, between 77 and 73, is a 400 volts DC with 12 volts pulses superimposed on the 400 volts DC.

The specific configuration of the circuits of FIG. 1A and FIG. 1B are now described. In FIG. 1A, terminal 1 is connected in parallel to core 81 at connection 3 capacitor 4, and resistor 5. Resistor 5 is also connected in parallel to transistor 6, diode 7, capacitor 8, and resistor 9. Connection 2 to the negative side of the electrical system of the vehicle, is connected in parallel to capacitor 4, transistor 6, diode 7, transistor 10, and diode 11. Transistor 10 is connected at point 12 (input to the primary winding) to second winding 14 around saturable ferrite core transformer 81. Transistor 10 is also connected at point 13 (the output feedback) to third winding 15 around transformer 81. Capacitor 8 and resistor 9 are connected at point 16 (output from feedback) to third winding 15 around transformer 81. Transistor 6 is connected at point 17 (input to primary) to first winding 18 around transformer 81. First winding 18 and second winding 14 are each 7 turns of number 20 wire. Third winding 15 is 9 turns of number 20 wire. Fourth winding 19 is 225 turns of number 30 wire, and fifth winding 20 is 10 turns of number 30 wire.

In FIG. 1B, the 400 volts AC input at point 50 is connected in parallel to diodes 59 and 60. The 12 volts AC input at point 51 is connected in parallel to diodes 53 and 54 The system ground input at point 52 is connected in parallel to diodes 55, 56, 57 and 58. Diodes 53, 56, 57 and 60 are connected in parallel to capacitors 61 and 62, resistor 65, SCR 76, diode 69 and at point 71 to first winding 78 around pulse transformer core 80. Diodes 54 and 55 are connected in parallel to capacitor 61, resistor 67 and resistor 66. Resistor 67 is connected in parallel to capacitor 62 and transistor 75. Resistor 66 is connected to transistor 75. Transistor 75 is connected in parallel to resistor 65 and SCR 76. Diodes 58 and 59 are connected in parallel to resistor 68. Resistor 68 is connected in parallel to SCR 76, diode 69 and capacitor 64. Capacitor 64 is connected at point 72 to first winding 78 around pulse transformer core 80. Second winding 79 around pulse transformer core 80 is connected at point 74 to diode 70. High voltage rectifier diode 70 is connected to output point 77. The ratio of the number of turns in the first winding 78 to the number of turns in the second winding 79 is 1:125, around pulse transformer core 80.

The prior art invention delivers a high voltage DC with low voltage pulses superimposed on the high voltage DC to a positive plate of a capacitor connected between 73 and 77. The positive plate of the capacitor is separated from and coupled to the grounded metal object by means of a capacitive pad.

Figure 2:
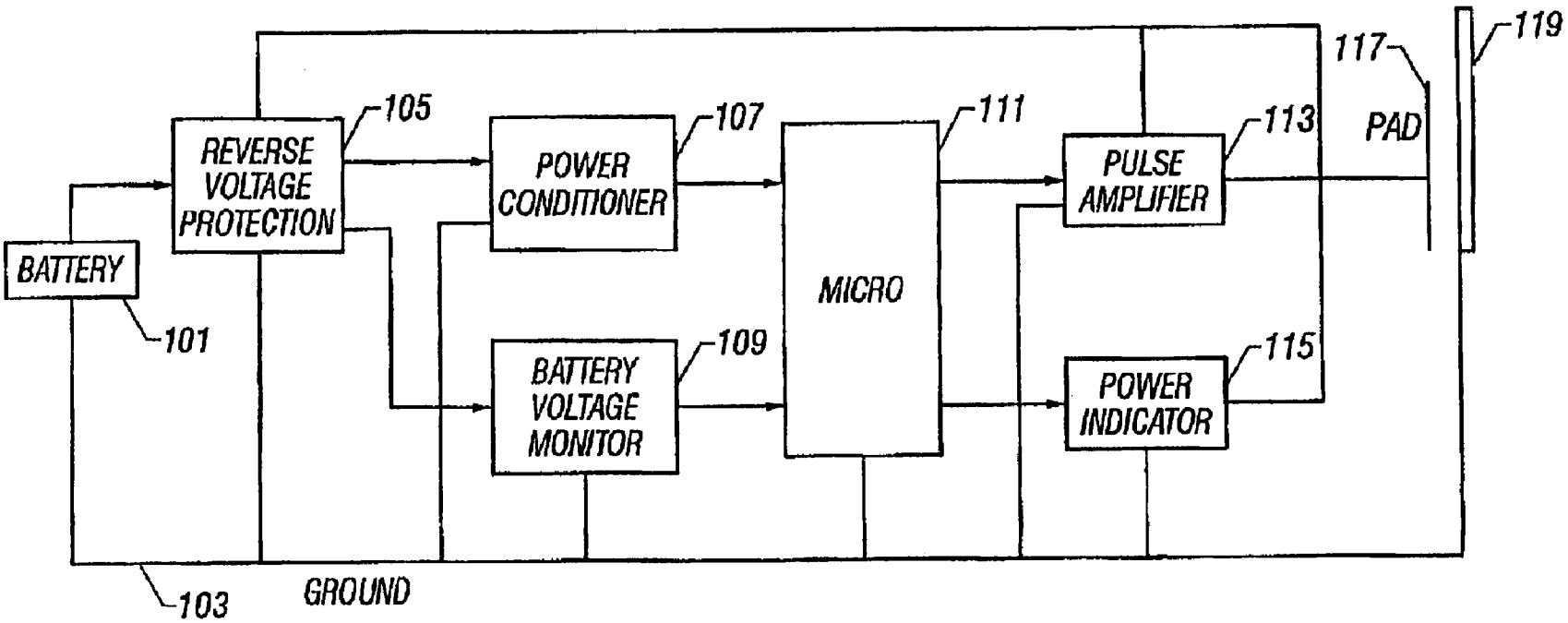
FIG. 2 is a schematic diagram of the apparatus of the present invention.

FIG. 2 is a functional block diagram illustrating the operation of an apparatus of the present invention. The battery 101 is the source of DC power for the invention. One terminal of the battery is connected to ground 103 The positive terminal of the battery is connected to the reverse voltage protector 105. The reverse voltage protector prevents application of reverse battery voltage from being inadvertently applied to the other circuitry and damaging the components.

A power conditioner 107 converts the battery voltage to the proper voltage needed by the microprocessor 111. In the preferred embodiment, the voltage needed by the microprocessor is 5.1 volts DC. The battery voltage monitor 109 compares the battery voltage with a reference voltage (12 volts DC in the preferred embodiment). If the battery voltage is above the reference voltage, then the microprocessor 111 activates the pulse amplifier 113 and the power indicator 115 When the pulse amplifier is activated by a pulse signal having a positive output of the microprocessor, an amplified pulse signal having a positive output is generated by the pulse amplifier and conveyed to the pad 117. The pad 117 is capacitively coupled to the metal object being protected, 119. When the power indicator 113 is activated, a power LED in the power indicator is turned on, serving as an indicator that the pulse amplifier has been activated. Of course, when the battery voltage drops below the reference voltage, all the circuits except the circuit for detecting the battery voltage can be turned off to minimize power consumption. The use of the battery voltage monitor 109 prevents drain on the battery if the battery voltage is too low.

When the present invention is used to protect a metal object, such as the body of an automobile, the pad 117 has a substrate material made of a suitable dielectric, which in this case is similar to thin fibre glass and is attached to the object 119 by means of a high dielectric strength silicone adhesive. In the preferred embodiment, the substrate-adhesive combination has a breakdown potential of at least 10 kilovolts. The adhesive is preferably a fast curing one, which will cure sufficiently in 15 minutes to secure the dielectric material to the metal object.

Figure 3A:
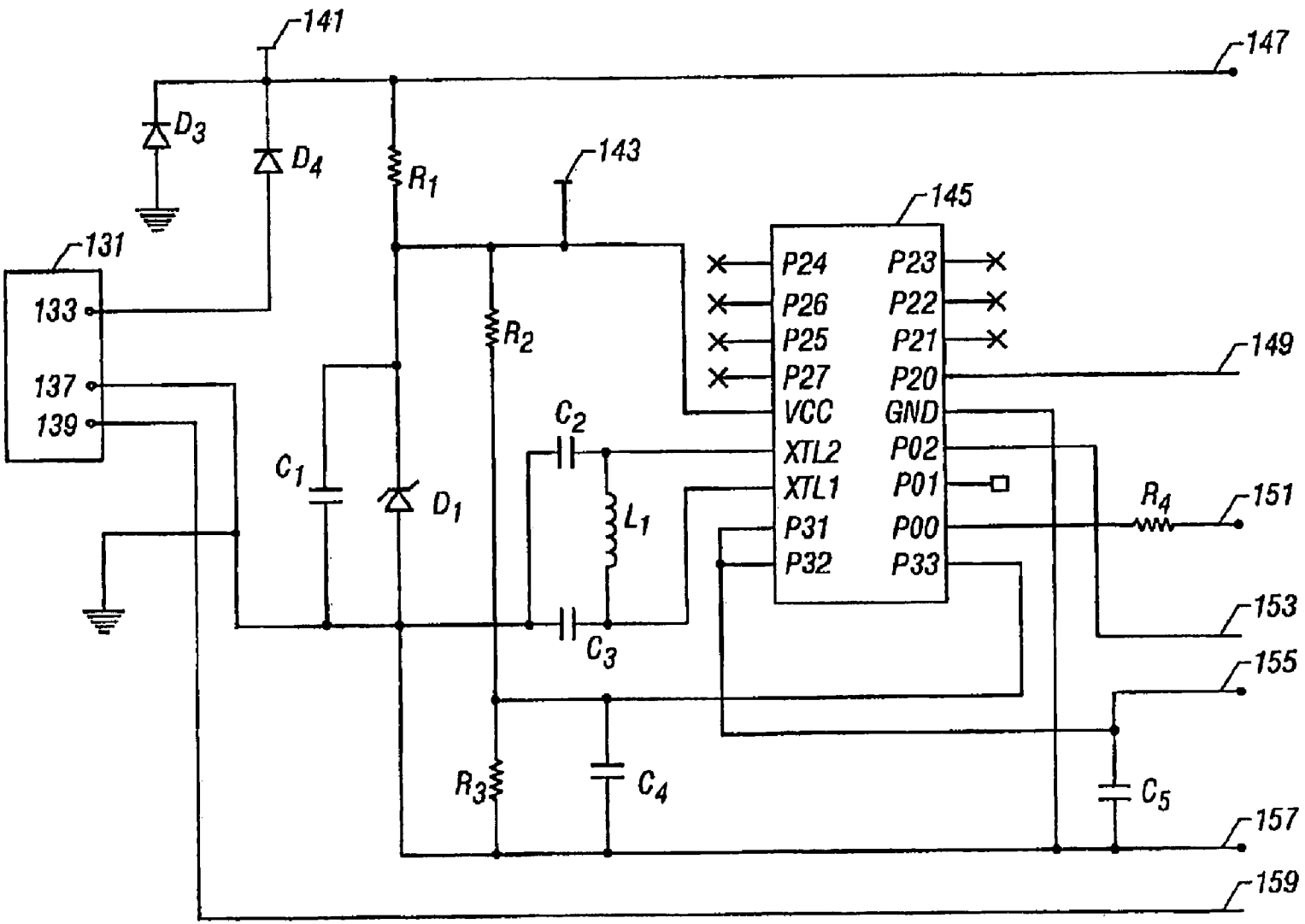
FIGS. 3A, 3B and 3C are circuit diagrams of the preferred embodiments of the present invention.
Figure 3B:
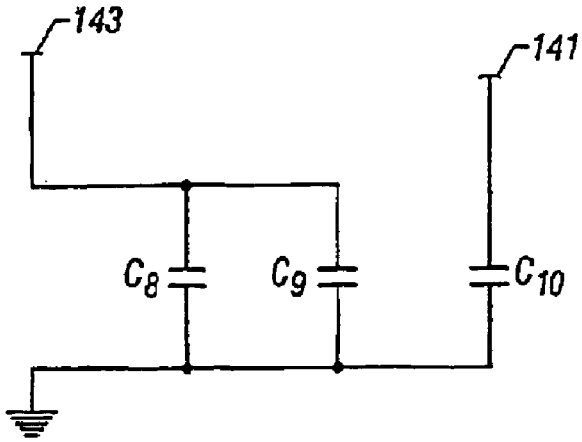
Figure 3C:
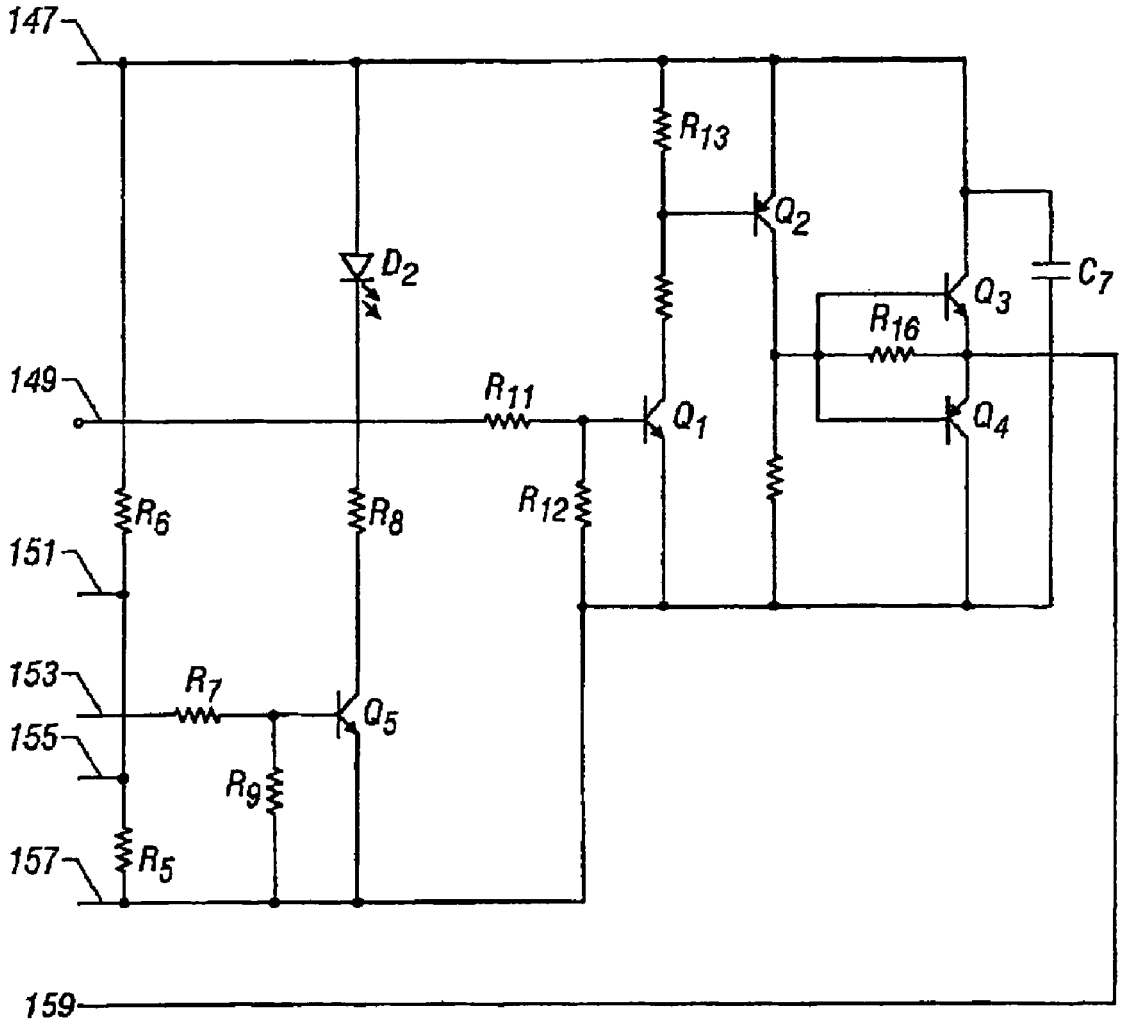

With the broad overview of the invention in FIG. 2, the details of the device, shown in FIGS. 3A–3C are easier to understand. Nodes numbered 147, 149, 151, 153, 155, 157 and 159 in FIG. 3A are connected to the correspondingly labelled nodes in FIG. 3C. The unit is powered from a typical car battery in which the positive terminal of the battery is connected to terminal 133 on a connector panel 131. The negative terminal of the battery is connected to the body of the car ("ground") and to terminal 137 on the connector panel 131. The pad 117 from FIG. 2 is connected to terminal 139 on the connector panel 131 while the metal object 119 being protected in FIG. 2, is connected to the ground. The car battery, the pad 117 and the metal object 119 being protected and their connections are not shown in FIG. 3A.

The reverse voltage protection circuit 105 of FIG. 2 comprises of the diodes $D_3$ and $D_4$ in FIG. 3A. In the preferred embodiment of the invention, $D_3$ and $D_4$ are IN4004 diodes. Those who are familiar with the art will recognize that with the configuration of the diodes as shown, the voltage at the point 141 will not be at a significant negative voltage with respect to the ground even if the battery is connected to the connector board 131 with reversed polarity. This protects the electronic components from damage and is an improvement over prior art. As shown in FIG. 3A, a VCC voltage supply is connected to the common terminals of R1, R2, C1, D1 and the VCC input of microprocessor 145.

The power conditioner circuit 107 in FIG. 2, is made of resistor $R_1$, Zener diode $D_1$ and capacitor $C_1$. These convert the nominal battery voltage of 13.5 volts to the 5.1 volts needed by the microprocessor. In the preferred embodiment, $R_1$ has a resistance of 330Ω, $C_1$ has a capacitance of 0.1 μF and $D_1$ is an IN751 diode. As would be known to those familiar with the art, a Zener diode has a highly stable voltage drop for a very wide range of currents.

Capacitors $C_8$, $C_9$ and $C_{10}$ serve the function of filtering the battery voltage and the reference voltage. In the preferred embodiment, they each have a value of 0.2 μF. $C_8$ and $C_9$ could be replaced by a single capacitor with a value of 0.2 μF.

The battery voltage monitor comprises of resistors $R_2$, $R_3$, $R_4$, $R_5$ and $R_6$ and capacitors $C_4$ and $C_5$. The voltage is monitored by a comparator in the microprocessor 145. The voltage divider, comprising of resistors $R_2$ and $R_3$, provides a stable reference to the pin $P_{33}$ of the microprocessor 145. In the preferred embodiment, $R_2$ and $R_3$ each have a resistance of 100 kΩ. Accordingly, with the reference voltage of the Zener diode $D_1$ of 5.1 volts, the voltage at pin $P_{33}$ of the microprocessor would be 2.55 volts. In the preferred embodiment, the microprocessor 145 is a Z86ED4M manufactured by Zilog.

The battery voltage is divided by the resistors $R_5$ and $R_6$ and applied to the comparator input pins $P_{31}$ and $P_{32}$. In the preferred embodiment, $R_5$ has a resistance of 180 K and $R_6$ has a resistance of 100 KÙ. The comparator in the microprocessor 145 compares the battery voltage divided by $R_5$ and $R_6$, at pins $P_{31}$ and P32, with the divided reference of 2.55 volts at pin $P_{33}$. Whenever the voltage at pins $P_{31}$ and $P_{32}$ drops below the reference voltage at pin $P_{33}$, microprocessor senses a low battery voltage and stops sending signals to the pulse amplifier (discussed below). The necessity for connecting pin $P_{00}$ to the junction of resistors $R_5$ and $R_6$ through resistor $R_4$ arises because the comparator is responsive only to transitions wherein the voltage at pins $P_{31}$ and $P_{32}$ drops below the reference voltage at pin $P_{33}$. The pin $P_{00}$ is pulsed approximately every one second or so between 0 volts and 5 volts by the microprocessor. When the pin $P_{00}$ is at zero volts, then with a resistance of 100 KΩ for resistor $R_4$ in the preferred embodiment, the voltage at pins $P_{31}$ and $P_{32}$ is below the 2.55 volts reference voltage at pin $P_{33}$ when the battery voltage is below 11.96 volts. When the pin $P_{00}$ is at 5 volts, the voltage at $P_{31}$ and $P_{32}$ is above 2.55 volts. By this means, the microprocessor is able to sense a low battery voltage in continuous operation. Capacitors $C_4$ and $C_5$ provide AC filtering for these voltages.

Those familiar with the art would recognize that the requirement for cycling pin $P_{00}$ between two voltage levels, and the requirement for resistor $R_4$, would not be necessary in other microprocessors in which the comparator may be responsive to actual differences between a reference voltage and a battery voltage, rather than to a transition of the battery voltage below the reference voltage.

The use of a microprocessor to generate pulses of DC voltage and the use of a battery voltage monitor to shut down the apparatus when the battery voltage drops below a reference level are improvements over prior art methods. However, those of skill in the art will understand that there are well known logic circuits in the art, such as oscillator/pulse generator circuits, that can be used to generate the pulses. The Power Indicator comprises an LED $D_2$, transistor $Q_5$ and resistors $R_7$, $R_8$ and $R_9$. The transistor $Q_5$ is driven on by a positive output of the microprocessor at pin $P_{02}$. When the transistor $Q_5$ is on, the LED $D_2$ is lit. If the battery voltage is reduced to a nominal 12 V, the microprocessor does not have a positive output at pin $P_{02}$ and the LED $D_2$ is turned off. When the battery voltage rises above a nominal 12 volts, the microprocessor has a positive output on pin $P_{02}$ and the LED $D_2$ is turned on.

In the preferred embodiment, $Q_5$ is a 2N3904 transistor, $R_7$ has a resistance of 3.9 KΩ, $R_8$ has a resistance of 1 KΩ and $R_9$ has a resistance of 10 KΩ.

When the battery voltage is above the nominal 12 V, the microprocessor also produces an output pulse on pin $P_{20}$. This is sent to the Pulse Amplifier, comprising of resistors R1–$R_{16}$ and transistors $Q_1$–$Q_4$. In the preferred embodiment, $Q_1$, $Q_3$ and $Q_5$ are 2N3904 transistors, $Q_2$ and $Q_4$ are 2N2907 transistors; $R_{11}$ has a resistance of 2.7 KΩ, $R_{12}$ and $R_{13}$ each have a resistance of 1 KΩ, $R_{14}$ and $R_{15}$ have resistances of 390Ω, and $R_{16}$ has a resistance of 1 KΩ. The capacitor $C_7$ provides AC filtering for the pulse amplifier circuit and, in the preferred embodiment, has a capacitance of 20 μF. The output of the pulse amplifier is applied, through 139 in the connector panel 131, to the coupling pad 117 that is attached to the car body. The output has a nominal amplitude of 12 volts.

With the complete absence of any transformers in the invention, high efficiency can be readily achieved. This reduces the drain on the battery and is an improvement over the prior art. In a presently preferred embodiment, the signal from pin $P_{20}$ of the microprocessor comprises of a pulse with nominal characteristics of a 5 V amplitude, a 3 microsecond width and a 10 kHz repetition rate. For electrical waveforms of the pulse type, the rise and fall times of the amplified pulse signal that is applied to the pad 117 determines its high frequency content and hence the temporal variation in the electrical waveform. In a presently preferred embodiment, the rise time and the fall times of each pulse that forms the amplified pulse signal are about 200 ns.

The clock frequency for the microprocessor in the presently preferred embodiment is determined by the resonant circuit comprising capacitors $C_2$ and $C_3$ and the inductor $L_1$. Use of this circuit is more cost effective than a quartz crystal for controlling the microprocessor clock. This is an improvement over the prior art. In the preferred embodiment, $C_2$ and $C_3$ have a capacitance of 100 μF while the inductor LI has an inductance of 8.2 μH. Those familiar with the art would recognize that other devices or circuits could be used to provide the timing mechanism of the microprocessor.

Figure 4:
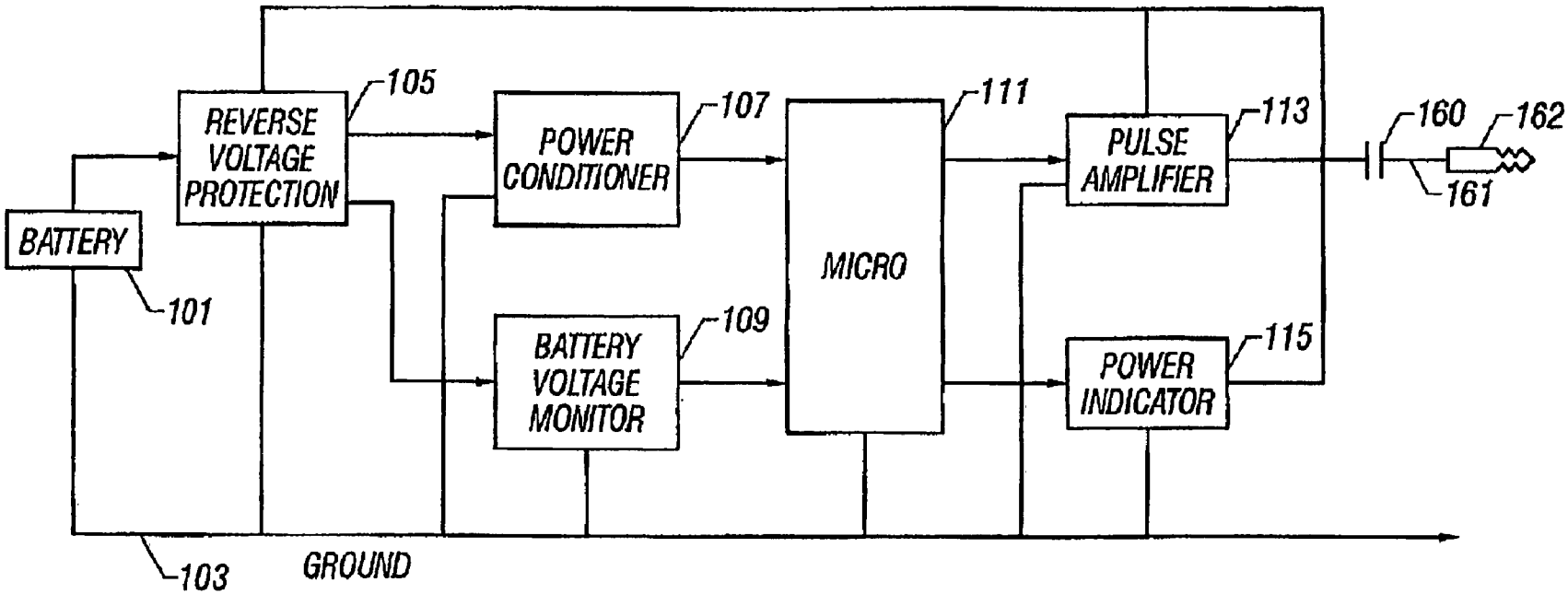
FIG. 4 is an alternative embodiment of the present invention.

Turning now to FIG. 4, an alternative embodiment of the present invention is illustrated which utilizes an internal capacitor 160, lead 161 and fastener 162 to deliver pulses to the metal object 119, instead of capacitive pad 117. In FIG. 4, the output of pulse amplifier 113 is attached to the positive side of capacitor 160. The negative side of capacitor 160 is attached to lead 161, which is attached to fastener 162. The output pulses from pulse amplifier 113 are thus transmitted to metal object 119 via the path formed by capacitor 160, lead 161 and fastener 162, which is attached to metal object 119.

Figure 5:
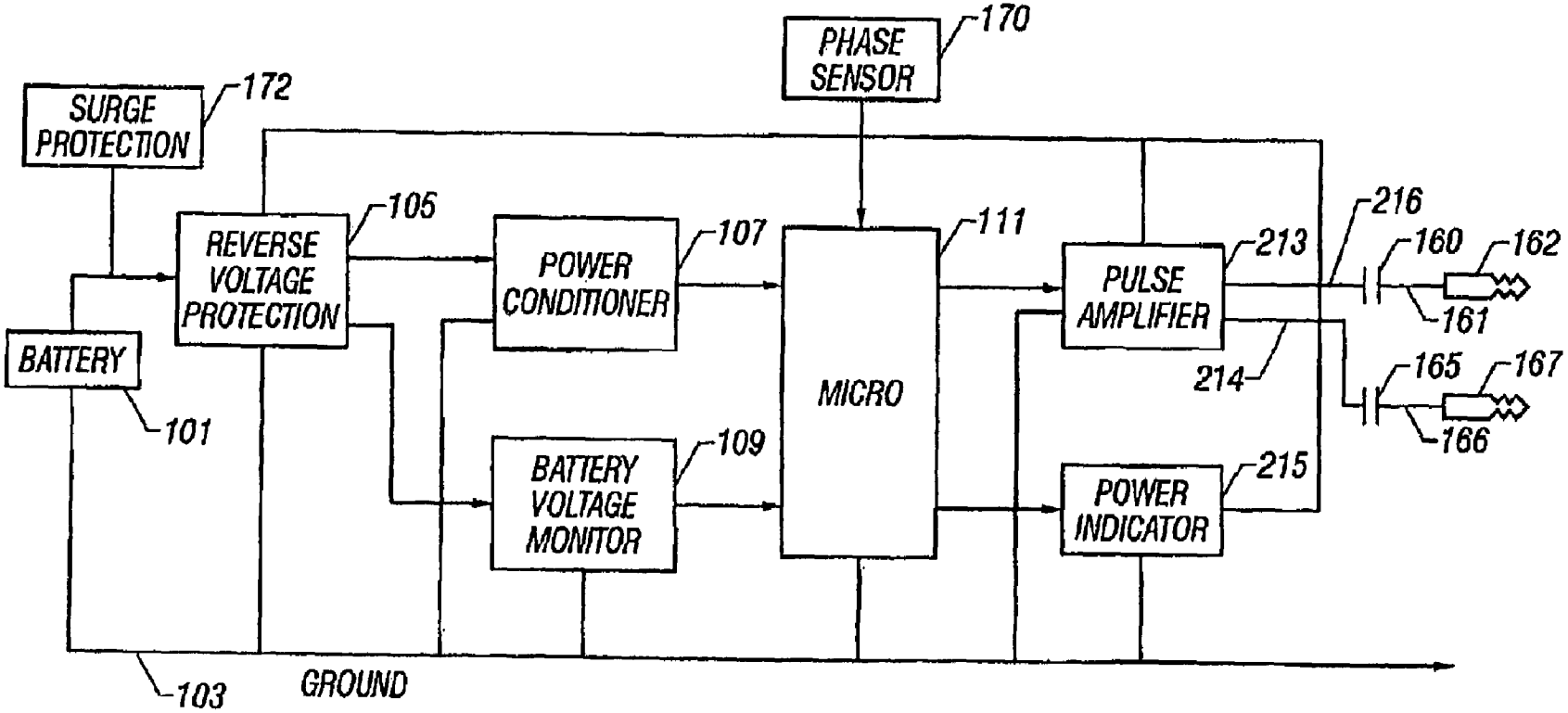
FIG. 5 is a preferred embodiment of the preferred phase compensation of the present invention.

Turning now to FIG. 5 a preferred embodiment of the present invention is shown illustrating the phase sensor and adjustment circuitry for a system provided with two or more electrodes. The present invention provides two or more electrodes for attachment to large metallic structures, such as water storage tanks and metallic storage sheds or large vehicles. A first and second electrode are attached to the metallic structure or vehicle being treated so that the effects of the invention are applied simultaneously at two or more points. Each of the electrodes applies a time varying electrical waveform to the object being treated. A sinusoidal waveform is an example of a preferred waveform which can be applied, however any suitable waveform can be applied with similar effectiveness. A first electrode on a short cable is applied at one point on the metal object and a second electrode attached to a longer cable is applied at a second point on the metal object being treated. A phase sensor is used to adjust the signal so that the impedance difference of the long cable and short cable does not affect the phase synchronous relationship of the two applied signals. That is, the phase relationship of the signals applied to the metal object and complex impedance of the first and second cable is determined and the signal applied to each cable is phase compensated and adjusted so that the signals at the distant end of each cable are phase synchronous or are in phase when applied to the metal object. A high voltage protection circuit is provided to protect the present invention from damage from a high voltage spike or surge. A variable speed blinking light emitting diode (LED) is provided to indicate battery power levels of full, marginal and low.

As shown in FIG. 5, a first lead 161 and a second lead 166 are driven by pulse amplifier 213 via signal lines 216 and 214 respectively, in response to the signal pulses provided by microprocessor 111. Pulse amplifier 213 contains phase delay circuitry to adjust for any phase delay due to impedance differences between cable 161 and cable 166 which may be of different lengths and thus exhibit different impedances and phase delays. Different impedance in each cable tends to independently shift the phase of each output signal at the distant end of the cable as applied to the object via fastener 162 or 167. Thus, the present invention provides phase compensation, that is, phase sensing of each output signal at the fastener or application point to an object and appropriate phase compensation or delay to bring each output signal into phase synchronization. Thus, the present invention monitors and adjusts the phase of the output signal at each fastener 162 and 167. Otherwise, the applied signals can be out of phase synchronization and cause the application of the output signals to be less effective. It is more electrically efficient to adjust the phase of each fastener applied signal so that the peak of each fastener signal is coincident with the peak of other fastener signals applied to a metal object. Thus, the present invention insures that each signal at each fastener applied to a metal object is phase synchronous.

The phase of each signal at each fastener can be determined by attaching each fastener 162 and 167 to a phase sensor 170 to determine the phase relationship of each signal at each fastener 162 and 167, after the signal has passed through the delivery cables 161 and 166 and capacitors 160 and 165. The microprocessor 111 determines a phase difference and sends a phase delay signal to pulse amplifier 213, which applies a phase delay signal to pulses sent to each cable so that the signals are in phase synchronization when applied to an object through the fasteners. The phase sensor and pulse amplifier can also sense and adjust for differences in the complex impedance between two applied signals. A similar circuit is used to adjust the phase of applied signals in the embodiment where capacitive coupling is used to apply the signals to an object.

Power indicator 215 comprises a voltage sensing circuit, a flasher and a voltage indication and LED. The power indicator circuit causes the LED to flash at ⅛ Hertz when the supply voltage is twelve volts, at ¼ Hertz when the supply voltage is less than twelve volts and greater than 11.7 volts, and at ½ Hertz when the supply voltage is less than 11.7 volts. A surge protection circuit 172 is provided to protect the present invention from high voltages due to regulator failure or other sources of high voltage.

As previously mentioned in the description of the invention shown in FIG. 5, the microprocessor 111 can generate an electrical waveform, such as a train of pulses for example, for application to the metallic structures. As previously discussed, an electrical waveform has a time-varying component ,and can be of a pulse type or a sinusoid type, and have various characteristics such as a specific frequency spectrum, repetition rate and rise/fall times. In this present embodiment, the generation or inducement of a surface current on the metallic structure is effective for inhibiting corrosion of the metallic structure. While surface currents can be generated in response to a time varying electrical waveform, applied to the metallic structure, the microprocessor 111 and the pulse amplifier 113 provide unipolar pulsed DC based signals. However, a Fourier transform of such a signal indicates that in addition to a DC component, the signal also includes many AC components. Generally it has been observed that the highest frequency components are found to be about 0.35/Trf, where Trf is the rise/fall time of the pulse, which ever is smaller. While a unipolar DC signal is used in the present embodiments, a bipolar DC signal can be used instead with equal effectiveness. A unipolar signal refers to a signal that makes voltage or current excursions in only the positive or the negative direction, while a bipolar signal refers to a signal that makes voltage or current excursions in both the negative and positive directions, such as a sinusoidal waveform for example.

Those of skill in the art will understand that in the field of digital signal communications, wires carrying digital signals can exhibit undesired inductance and capacitive characteristics. Hence they can behave as a resonant LC circuit which can cause undesired transients, and ringing of the signal at the receiving end of the circuit. At high transmission speeds where the rise and fall times are very, short this can pose a serious problem. While practitioners in the digital signal communications field have been working towards minimizing this effect, such transients are preferred for the embodiments of the present invention. These transient AC components of the electrical waveforms of a pulse type will enhance the frequency component at which the effective LC circuit oscillates, and hence enhance surface current generation that reduces the corrosion rate. It is noted that the electrical waveforms can have any shape, as long as they possess a time varying (AC) component. Naturally, for waveforms of a pulsed type, the microprocessor 111 can be set to provide the pulse signals at a high frequency, and short rise/fall times, to generate the time varying (AC) components. Of course, those of skill in the art will understand that any suitable high-speed pulse generation circuit can be used instead of microprocessor 111.

It is noted that surface current generation can be enhanced if the electrical waveform contains frequencies at which the metallic object resonates. Since a vehicle is a complex electrical structure with respect to AC electrical excitation, it can have an electrical resonance at many of the frequencies generated by the electrical waveform. The exact resonant frequencies of the vehicle are determined by the structure of the vehicle and the parasitic capacitances and inductances present in the electrical circuit and the wires used to attach the circuit. Not only will large surface currents result, the surface currents will radiate efficiently, turning the metallic object into an effective antenna. Thus, by selecting the appropriate waveform shape, and hence frequency spectrum, optimum corrosion inhibition can be obtained. However, those of skill in the art will understand that it is preferable to control this process in order to avoid RF interference problems.

In an alternate embodiment where high frequency components are not possible, or undesired, the high frequency components can be minimized by reducing the maximum rate of change present in the electrical waveform. For pulse waveforms this means the reduction of the rise and fall times of the pulse. It is noted that low duty cycle pulse waveforms with modest rise and fall times are effective for inducing surface currents in the metal body being protected. A modest rise and fall time refers to times similar to those disclosed in the present embodiments of the invention. In particular, it is noted that the rise and fall times of appropriate duration, for a pulsed waveform are primarily responsible for generation of the surface currents. Circuit techniques for minimizing signal rise/fall times are well known to those of skill in the art.

An alternate technique for generating surface currents in a metallic object is to capacitively couple the electrical waveforms directly to the metallic object to induce surface current generation. This can be accomplished through direct discharge through the metal object or through field induced surface current generation. Following is a description of circuits for capacitively coupling electrical waveforms to a metal object according embodiments of the present invention.

Figure 6:
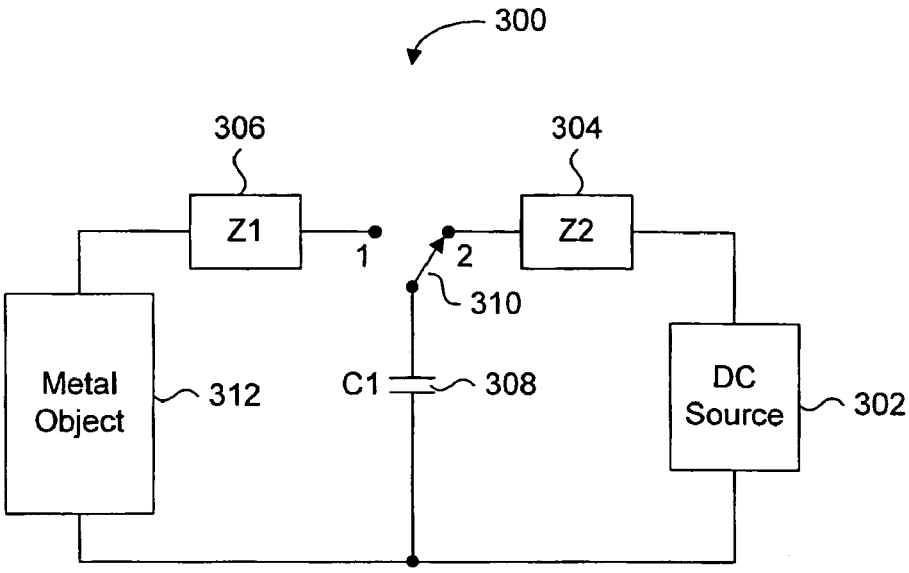
FIG. 6 is a circuit for capacitively coupling electrical waveforms to a metallic object according to an embodiment of the present invention.

FIG. 6 shows a schematic of a circuit for coupling an electrical waveform to a metallic object by direct discharge according to an embodiment of the present invention. The circuit includes a charge circuit having a DC voltage source for providing a capacitive discharge, and a current generation circuit coupled to the metal object for receiving and shaping the capacitive discharge from the charge circuit. A terminal of the DC voltage source is connected to the metal object, and the current generation circuit applies the shaped capacitive discharge to the metal object for inducing a surface current therein. The capacitive coupling circuit 300 includes a DC voltage source 302, such as a battery, impedance devices 304 and 306, capacitor 308, switch 310 and the metallic object 312. In the present example, DC voltage source 302, impedance device 304, capacitor 308 and switch 310 form the charge circuit for providing the capacitive discharge from capacitor 308 via switch 310. In particular, capacitor 308 is arranged in parallel to DC voltage source 302, and switch 310 couples capacitor 308 to DC voltage source 302 in a charging position for charging the capacitor, and to an output in a discharging position for discharging capacitor 308. In the present example, the output can be node "1" of switch 310 and the current generation circuit includes impedance device 306. Impedance device 304 limits current while capacitor 308 is charged, and impedance device 306 is used to shape the current waveform to be applied to the metallic object 312. While not shown, voltage source 302 includes a polarity switch circuit to reverse its polarity. Switch 310 is controlled to electrically connect the plate of capacitor 308 to either position 1 or position 2 in FIG. 6. Preferably, the two terminals of capacitor 308 are connected some distance away from each other on the metallic object 312. Those of skill in the art will understand that the specific type and values of impedance devices 304, 306, capacitor 308, and voltage source 302 are design parameters. In other words, their values are selected to ensure that surface currents effective for reducing the rate of corrosion in the metallic object 312 are induced.

In operation, switch 310 is set to position 2 to charge capacitor 308 by voltage source 302 via impedance device 304. It is assumed in this example that the voltage source 302 starts with the negative terminal connected to the bottom plate of capacitor 308. Once charged, switch 310 is toggled to position 1 to discharge the stored charge through the metallic object 312 via impedance device 306. Thus, a surface current is generated through the metallic object as the positive charge on the top plate of capacitor 308 is discharged through the metallic object 312. Switch 310 is then toggled back to position 2 and the polarity of voltage source 302 is reversed via the polarity switch circuit, such that the bottom plate of capacitor 308 becomes positively charged. When switch 310 is toggled to position 1, a surface current in the opposite direction is generated through the metallic object 312 Therefore, charge is applied to and drawn from the metallic object 312 as switch 310 is toggled between positions 1 and 2, and the polarity of voltage source 302 is reversed each time switch 310 returns to position 2.

Accordingly, the frequency at which capacitor 308 is charged and discharged can be controlled by microprocessor 111, and in particular by the electrical waveform provided by microprocessor 111. More specifically, switch 310 and the switch circuit of voltage source 302 can be controlled by the electrical waveform. Therefore, the electrical waveform is effectively coupled to the metallic object since the discharge voltage of capacitor 308 corresponds to an active phase of the electrical waveform. In alternate embodiments, many capacitors working in parallel can be selectively connected to the metallic object to ensure that surface currents are induced throughout the metallic object 312 and the capacitor(s) can be charged mechanically by doing work on the dielectric separating the capacitor plates. Furthermore, those of skill in the art will understand that a bipolar voltage source can be used instead of the unipolar voltage source 302 described for FIG. 6 to obviate the need for a polarity switch circuit.

Figure 7:
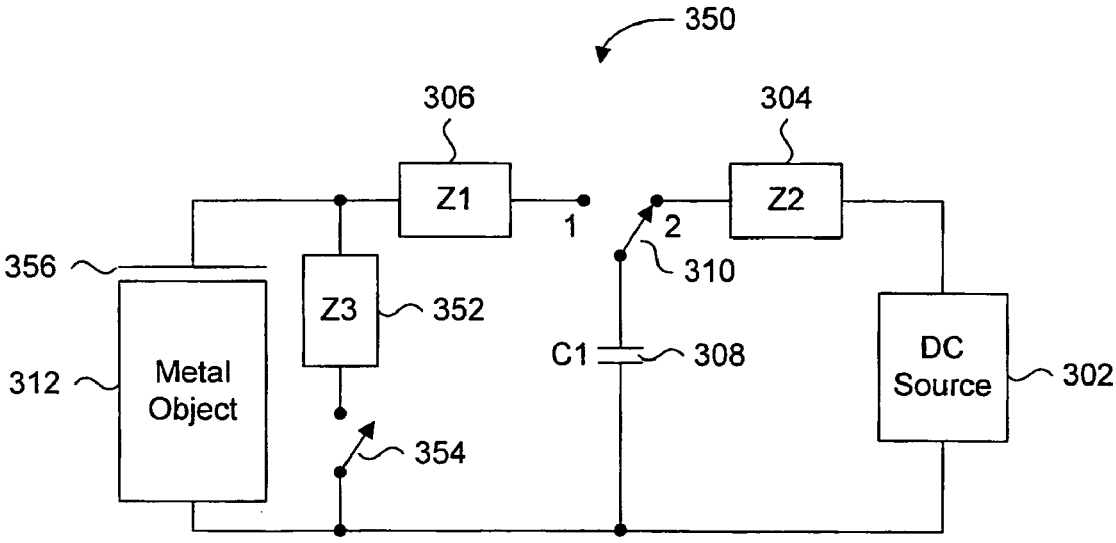
FIG. 7 is a circuit for capacitively coupling electrical waveforms to a metallic object according to another embodiment of the present invention; and, FIG. 8 is a plot of corrosion potential over time for a test panel and a control panel.

FIG. 7 shows a schematic of a circuit for coupling an electrical waveform to a metallic object by field induced surface current generation according to an embodiment of the present invention. The circuit includes a charge circuit having a DC voltage source for providing a capacitive discharge, and a current generation circuit coupled to the metal object for receiving and shaping the capacitive discharge from the charge circuit. A terminal of the DC voltage source is connected to the metal object, and the current generation circuit applies the shaped capacitive discharge to the metal object for inducing a surface current therein. Circuit 350 includes the same elements as shown in circuit 300 of FIG. 6, and arranged in the same configuration, but adds a third impedance device 352, a second switch 354 and a distributed capacitor plate 356. In the present example, DC voltage source 302, impedance device 304, capacitor 308 and switch 310 form the charge circuit for providing the capacitive discharge from capacitor 308 via switch 310. In particular, capacitor 308 is arranged in parallel to DC voltage source 302 and switch 310 couples capacitor 308 to DC voltage source 302 in a charging position for charging the capacitor, and to an output in a discharging position for discharging capacitor 308 In the present example, the output can be node "1" of switch 310. The current generation circuit includes impedance device 306, distributed capacitor plate 356, and a discharge circuit including impedance device 352 and switch 354. Impedance device 352 shapes the current signal as it is discharged through switch 354, and distributed capacitor plate 356 can be many individual capacitor plates located at different locations along the metallic object 312. In a variant of the present embodiment, each individual capacitor plate forming distributed capacitor plate 356 can have its own impedance 352 and switch 354. As in FIG. 6, those of skill in the art will understand that the specific type and values of impedance devices 304, 306, 352, capacitor 308, and voltage source 302 are design parameters selected to ensure effective surface current generation. Furthermore, the surface area of each individual capacitor can be tailored to yield a desired magnitude of surface current for a specific location on the metallic object 312 Tailoring may be required to compensate for the shape of the metallic object 312 and/or components connected to the metallic object 312, which may affect the distribution of the surface current.

In operation, switch 310 is set to position 2 to charge capacitor 308 by voltage source 302 via impedance device 304, while switch 354 is open. It is assumed in this example that the voltage source 302 is configured such that its negative terminal is connected to the bottom plate of capacitor 308. With switch 354 open, switch 310 is toggled to position 1 to distribute, or share, the stored charge with the distributed capacitor plate 356 via impedance device 306. Therefore, surface currents are generated through the metallic object as the distributed capacitor plate 356 is charged. More specifically, surface currents flowing in a first direction are induced as the distributed capacitor plate 356 is charged. With switch 310 in position 2, switch 354 is toggled to the closed position to discharge the distributed capacitor plate 356 and induce surface currents that flow in a second and opposite direction. Accordingly, when switch 310 is in position 2, capacitor 308 begins to charge. The cycle then ends by setting switch 354 to the open position.

Accordingly, the frequency at which capacitor 356 is charged and discharged can be controlled by microprocessor 111, and in particular by the electrical waveform provided by microprocessor 111. More specifically, switches 310 and 354 can be controlled by the electrical waveform, to maintain the aforementioned switching operation sequence. Therefore, the electrical waveform is effectively coupled to the metallic object since the distributed capacitor plate 356 is charged and discharged at a frequency that is related to the frequency of the electrical waveform. Those of skill in the art will understand that microprocessor 111 can be configured to generate more than one electrical waveform such that each electrical waveform controls switches 310 and 354 in the proper sequence.

An advantage of the present embodiment is the flexibility in customizing surface currents at different locations of the metal object by adjusting the values of the individual capacitors of the distributed capacitor plate 356 and the values of the components. Hence, corrosion reduction throughout the entire surface of the metallic object can be maximized regardless of its shape or size.

The previously described techniques for generating a surface current in a metallic object require a physical connection between the pulse signal generator circuit and the metallic object. A non-contact method for generating a surface current can involve the generation of an electromagnetic field to induce a surface current. For example, a magnetic field being moved over a metallic surface can induce eddy currents, some of which would be surface currents. Such a magnetic field can be provided by a permanent magnet, which can be passed over the metallic object surface at a frequency that can be controlled by the microprocessor 111. Therefore, the signal pulses are effectively coupled to the metallic object since the device generating the magnetic field is moved over a particular area of the metallic object in response to an active phase of the signal pulse.

Another non-contact technique for generating a surface current involves transmitting a signal with an appropriate shape (waveform) from an RF source through an antenna such that the transmitted signal is received by the metallic object. Accordingly, the signal pulses in this alternate embodiment can be used to generate the RF signals using well known RF circuits, which are then coupled to the metallic object via the transmitted signals.

Therefore, according to an embodiment of the present invention, the rate of corrosion or oxidation of a metal object can be reduced by generating electrical waveforms with predetermined characteristics from a suitable waveform generating circuit powered by a suitable source of electrical energy, such as a DC voltage source. By coupling the generated electrical waveforms to the metal object, surface currents are induced over the entire surface of the metal object. While the electrical waveforms are not directly coupled to the metallic object in the capacitive coupling and non-contact techniques, they are considered to be indirectly coupled to the metal object as they can be used to control other components for inducing the surface currents. Those of skill in the art will understand that the circuit design and device parameters would be carefully selected to ensure that there is no interference with neighbouring systems that may be sensitive to time varying digital signals.

Because the surface current can be generated with low DC voltage sources, the embodiments of the present invention can be used in many practical applications since low voltage batteries, such as 12 volt DC batteries, are readily available and more pervasive than the high voltage sources required in the prior art.

To validate the corrosion inhibition effectiveness of the embodiments of the present invention, a corrosion test was conducted upon metal panels prepared for use as automobile body panels. A surface current test was conducted upon an automobile to ensure that surface currents were present while the apparatus was active to inhibit corrosion.

Figure 8:
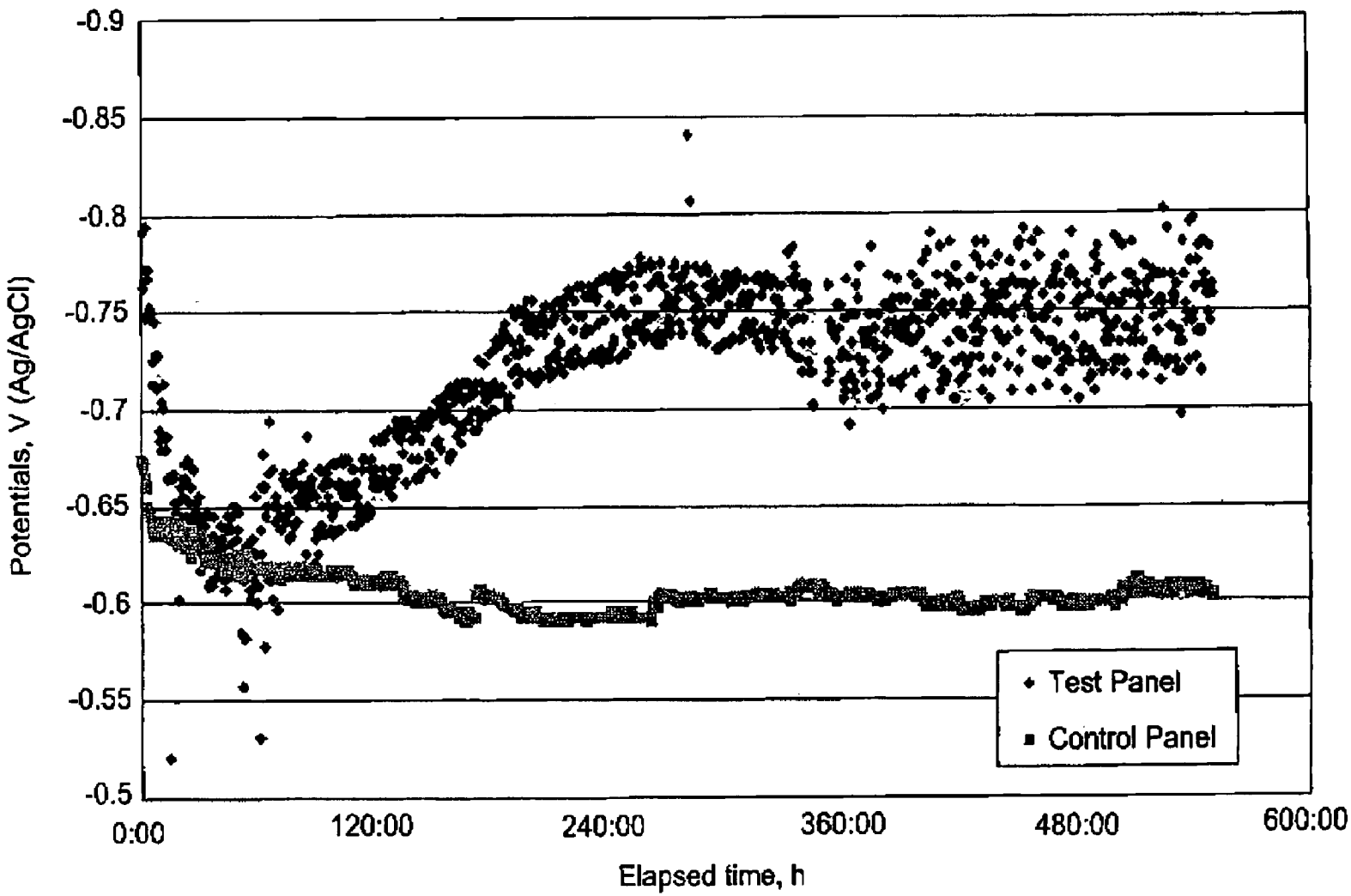

The corrosion inhibition effectiveness of the circuit embodiments of the present invention, referred to from this point forward as the module, was tested by scribing the panel to expose bare metal. The module, being powered by a standard car battery, had its terminals connected to the back of the metal panel. This test panel and a similarly scribed "control" panel were both continuously sprayed with a salt solution for a duration of over 500 hours. Reference electrodes mounted to each panel at the scribe locations monitored the potential of each panel over the duration of the test period. A visual inspection clearly showed that the test panel had experienced significantly less corrosion than the control panel, as evidenced by the lack of rust stains. Furthermore, the potential measurements of each panel showed that the test panel eventually attained a potential by about 150 mV more negative than that of the control panel. The plotted results of the voltage potential (in Volts) versus time (in hours) are shown in FIG. 8, where the test panel potentials are shown as diamonds and the control panel potentials are shown as squares. Therefore, it is concluded that the more negative potential of the test panel induced by the embodiments of the present invention, contributes to corrosion inhibition.

The surface current test involved connecting the module to an automobile and measuring the surface currents using well known techniques. In particular, one terminal of the module was connected to a drivers side ground bolt of the automobile and the other terminal of the module was connected to a fender body panel bolt on the passenger side of the automobile. A radio receiver with a calibrated loop current probe was used to detect and measure the surface current at different locations of the automobile body. The test concluded that surface current was detected over the entire surface of the automobile.

Therefore, the tests confirm that corrosion can be inhibited through the generation of surface currents, according to the previously described embodiments of the present invention.

While the above-described embodiments of the present invention are effective for reducing the rate of corrosion of a metal in the absence of a bulk electrolyte, they are equally effective in the presence of a bulk electrolyte. Furthermore, while low voltage DC voltage sources have been illustrated in the previously described embodiments of the present invention, high voltage DC voltage sources can be used with equal effectiveness too. Therefore, the embodiments of the present invention can be applied to large metal structures such as sea vessels with metal hulls.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A method for reducing a rate of corrosion of a metal object, comprising:

a) generating electrical waveforms having predetermined characteristics from a DC voltage source, each waveform having a temporal AC component;

b) coupling the electrical waveforms to the metal object; and, c) inducing a surface current over an entire surface of the metal object in response to the electrical waveforms.

2. The method of claim 1, wherein the step of coupling includes driving the electrical waveforms through at least two contact points on the metal object.

3. The method of claim 1, wherein the step of generating includes generating electrical waveforms having a shape conducive for generating the AC component.

4. The method of claim 1, wherein the electrical waveforms include a resonance frequency of the metal object.

5. The method of claim 1, wherein the step of coupling includes capacitively coupling the electrical waveforms from a first terminal to a second terminal connected to the metal object.

6. The method of claim 5, wherein the second terminal is connected to a ground terminal of the DC voltage source.

7. The method of claim 1, wherein the step of capacitively coupling includes charging a capacitor from the DC voltage source and discharging stored charge of the capacitor through the metal object to a ground connection between the DC voltage source and the metal object in response to the electrical waveforms.

8. The method of claim 7, wherein the capacitor is mechanically charged.

9. The method of claim 7, wherein a first terminal of the capacitor is connected to the metal object and a second terminal of the capacitor is connected to an area of the metal object distant from the ground connection.

10. The method of claim 7, wherein a polarity of the DC voltage source is reversed after the stored charge is discharged.

11. The method of claim 1, wherein the step of capacitively coupling includes charging a capacitor from the DC voltage source and discharging stored charge of the capacitor to a distributed capacitor coupled to the metal object in response to the electrical waveforms, the induced surface current traveling in a first direction in response to accumulation of stored charge on the distributed capacitor.

12. The method of claim 11, wherein the step of capacitively coupling further includes discharging the distributed capacitor in response to the electrical waveforms, the induced surface current traveling in a second direction opposite to the first direction in response to the discharge the distributed capacitor.

13. The method of claim 1, wherein the step of coupling includes moving a magnetic field over the metal object at a frequency corresponding to the predetermined frequency of the signal pulses.

14. The method of claim 1, wherein the step of coupling includes transmitting RF signals corresponding to the electrical waveforms, through an antenna for receipt by the metal object.

15. The method of claim 1, wherein the step of generating includes generating the electrical waveforms with rise and fall times of about 200 nanoseconds.

16. The method of claim 1, wherein the step of generating includes generating unipolar DC electrical waveforms.

17. The method of claim 1, wherein the step of generating includes generating bipolar DC electrical waveforms.

18. A circuit for reducing a rate of corrosion of a metal object, comprising:

a charge circuit having a DC voltage source for providing a capacitive discharge, a terminal of the DC voltage source being connected to the metal object; and, a current generation circuit coupled to the metal object for receiving and shaping the capacitive discharge from the charge circuit, the current generation circuit coupling the shaped capacitive discharge to the metal object for inducing a surface current therein.

19. The circuit of claim 18, wherein the charge circuit includes a capacitor coupled in parallel to the DC voltage source, and a switch circuit for coupling the capacitor to the DC voltage source in a charging position for charging the capacitor, the switch circuit coupling the capacitor to an output in a discharging position for discharging the capacitor.

20. The circuit of claim 19, wherein the current generation circuit includes an impedance device coupled between the output and the metal object for providing a shaped current waveform, the surface current being induced as the shaped current waveform is applied to the metal object.

21. The circuit of claim 20, wherein the DC voltage source includes a polarity switch circuit for reversing the polarity of the DC voltage source.

22. The circuit of claim 19, wherein the current generation circuit includes a distributed capacitor coupled to the metal object, an impedance device coupled between the output and the distributed capacitor for providing a shaped current waveform, the distributed capacitor receiving the charge from the shaped current waveform to induce the surface current, and a discharge circuit for discharging the charge of the distributed capacitor to the terminal for inducing a second surface current opposite in direction to the surface current.

23. The circuit of claim 22, wherein the discharge circuit includes a second impedance device coupled between the distributed capacitor and a discharge switch circuit, the discharge switch circuit selectively coupling the second impedance device to the terminal.

24. The circuit of claim 22, wherein the distributed capacitor includes at least two parallel connected individual plates.

25. The circuit of claim 24, wherein each of the at least two parallel connected individual plates has a different surface area.

* * * * *

UNITED STATES PATENT AND TRADEMARK OFFICE

CERTIFICATE OF CORRECTION

PATENT NO. : 7,198,706 B2
APPLICATION NO. : 10/846598
DATED : April 3, 2007
INVENTOR(S) : Michael E. Lewis It is certified that error appears in the above-identified patent and that said Letters Patent is hereby corrected as shown below:

Title page, item (63), priority application data, delete "6,331,243." and insert therefor --6,331,243, which is a continuation-in-part of application No. 09/066,174, filed on Apr. 24, 1998, now Pat. No. 6,046,515.--.

Signed and Sealed this

Twenty-fifth Day of December, 2007

JON W. DUDAS
*Director of the United States Patent and Trademark Office*